US007426987B2

(12) United States Patent
Umeda et al.

(10) Patent No.: US 7,426,987 B2
(45) Date of Patent: Sep. 23, 2008

(54) COMPACT COIN DENOMINATION DISCRIMINATING DEVICE

(75) Inventors: Masayoshi Umeda, Iwatsuki (JP); Minoru Enomoto, Iwatsuki (JP); Hiroshi Otomo, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 51 days.

(21) Appl. No.: 11/451,125

(22) Filed: Jun. 12, 2006

(65) Prior Publication Data

US 2006/0278495 A1 Dec. 14, 2006

(30) Foreign Application Priority Data

Jun. 14, 2005 (JP) ..... 2005-174325

(51) Int. Cl.
*G07D 5/08* (2006.01)

(52) U.S. Cl. ..... 194/303

(58) Field of Classification Search ..... 194/303; 453/35, 49, 57

See application file for complete search history.

(56) References Cited

U.S. PATENT DOCUMENTS 3,485,910 A * 12/1969 Kennedy, Jr. ..... 264/129
3,610,635 A * 10/1971 Schiff et al. ..... 360/2
4,474,197 A * 10/1984 Kinoshita et al. ..... 453/57
4,548,220 A * 10/1985 Le Hong et al. ..... 453/3
4,705,154 A * 11/1987 Masho et al. ..... 194/319
6,039,166 A * 3/2000 Abe et al. ..... 194/317
6,053,807 A * 4/2000 Metzger et al. ..... 453/57
6,098,777 A * 8/2000 Hoffman et al. ..... 194/318
6,168,513 B1 * 1/2001 Souza et al. ..... 453/57
6,210,264 B1 * 4/2001 Richardson ..... 453/57
6,685,552 B2 * 2/2004 Nomura ..... 453/33

FOREIGN PATENT DOCUMENTS

JP 06-119527 4/1994
JP 10-177664 6/1998

* cited by examiner

*Primary Examiner*—Patrick Mackey
*Assistant Examiner*—Mark Beauchaine

(57) ABSTRACT

A coin denomination discriminating device for improving coin dispensing devices which incorporates components formed of non-magnetic material including a non-magnetic rotor having a coin receiving portion and a non-magnetic reference guide to guide coins from a storage coin holding bowl to a coin conveying device capable of selectively releasing coins of various denominations. Magnetic sensor units can be positioned along the coin movement path to provide characteristic signals representative of the coins independent of influence of metallic components in the transporting path. The non-magnetic members can be formed from wear resistant plastic material and relatively inexpensive magnetic sensors with coil and ferrite coils can be utilized adjacent the rotor.

20 Claims, 7 Drawing Sheets

COMPACT COIN DENOMINATION DISCRIMINATING DEVICE

BACKGROUND OF THE INVENTION

1. Field of the Invention

The present invention relates to a compact coin denomination discriminating device which can discriminate the denominations of a plurality of coins that are received in bulk, based on the diameter, material and thickness of the coins. The present invention also relates to a coin recycling machine which holds received coins of different denominations in holders according to denomination, and dispenses a specified number of coins in response to an instruction from a related machine.

2. Description of Related Art

The term "coin" used herein embraces currency coins, medallions, tokens and medals, which may be circular or polygon in shape.

In Japanese Patent No. 2,769,410, coins are sent one by one to a coin conveyance path when latched by a pin projecting from a turn table that turns within a hopper. Coin denomination is discriminated based on a diameter acquired by a coin diameter detecting unit during conveyance by the turn table pin. A coin pushing member is activated based on the timing detecting unit disposed before individual denomination-based coin storages in the coin conveyance path. When a coin denomination is determined, the coin is caused to drop into a corresponding coin storage location.

In Japanese Patent No. 3,198,288, a resin wiper is rotatably disposed between a base casing and a lid member made from plastic mold, each of the base casing and the lid member is provided with a detection coil, and a medal is pushed against a reference plane of the wiper by a guiding piece having a guiding portion which is an arc formed toward the center from the circumference of the wiper. Data concerning the material and diameter of a metallic medal is acquired by detection coils.

In Japanese Patent No. 2,769,410, since the denomination of a coin is discriminated only by a diameter measurement acquired from a coin diameter detector, there is a measurement problem that the accuracy in the discrimination of a specific denomination may be poor.

Since the discrimination of the coin relies only on the diameter, coins of the same diameter would be discriminated as real coins regardless of the material or thickness, and determined as a denomination corresponding to that diameter, so that there arises a problem that fake coins cannot be discriminated.

Additionally, the coin diameter detector is implemented by an optical sensor.

Since a metal chain is used as coin conveying means, if a magnetic sensor that is commonly used for discriminating coin denomination is used, the magnetic sensor could be influenced by the metal chain, so that accurate discrimination cannot be achieved.

In Japanese Patent No. 3,198,288, if the processing speed of coin discrimination is increased, a medal may leave a reference plane due to centrifugation force because the medal is elastically pushed toward the rotary center from the circumference by a wiper, which may interfere with an accurate detection.

In addition, when coins of different diameters are inserted, accuracy of diameter detection cab be poor because the guiding portion of medal must be arcuate. In other words, erroneous discrimination may occur when a plural denominations of coins having different diameters are attempted to be discriminated.

SUMMARY OF THE INVENTION

It is a first object of the present invention to provide a coin denomination discriminating device capable of realizing a high discrimination accuracy when a plural of different denominations of coins are subjected to denomination discrimination during conveyance.

It is a second object of the present invention to provide a coin denomination discriminating device for realizing high discrimination accuracy and also suited for use in a miniaturized coin receiving apparatus.

In order to achieve the above objects, a coin denomination discriminating device can be configured as follows. A coin denomination discriminating device can be formed of a non-magnetic material and can acquire data for discriminating coin denomination while conveying coins one by one to a predetermined position. The denomination discriminating device can include a rotor having a coin receiving portion, a magnetic sensor disposed on one side of a movement path of the coin receiving portion and on a side opposite to the one side in a facing manner, and a reference guide for guiding a coin, is disposed on an outer circumference of the movement path.

In such a configuration, a coin is received by the coin receiving portion of the rotor, and conveyed to a predetermined position via a predetermined movement path by rotation of the rotor. A coin residing in the coin receiving portion travels through the movement path by rotation of the rotor, and passes between magnetic sensors disposed so as to face each other on one side and an opposite side of the movement path.

Since the magnetic sensors are disposed on one side and the other side of the coin, and a magnetic flux of the magnetic sensors transmits through the non-magnetic material forming both the slide base and the rotor and only acts on a coin that is made of metal, the detection data will be accurate.

Further, a coin conveyed by the rotor is guided by a reference guide which is situated on an outer circumference of the rotor, and data for discrimination is accurately acquired.

As a result, the coin is guided while being pushed against the reference guide by a centrifugal force. Therefore, even if the rotation speed of the rotor increases, namely the discrimination speed of coin is increased, the coin will not leave the confines of the reference guide.

Therefore, the positional relationship between the magnetic sensor for acquiring discrimination data of coin guided by the reference guide and a coin of specific denomination is usually kept constant, so that data obtained from the magnetic sensor is accurate and the accuracy of coin discrimination is improved.

The reference guide further has a linear guide part with this configuration, a coin is guided by the reference guide part while being conveyed by rotation of the rotor. Therefore, the coin can linearly move in close contact with the linear reference guide part by a centrifugal force while its circumferential face is guided.

Since the magnetic sensor is arranged to face the reference guide, it can be positioned adjacent a location of a linear movement of the coin, and diameters of different denominations of coins can be accurately detected.

The invention is characterized in that the denomination discriminating device is provided with slide base made of a non-magnetic material, and a rotor made of a non-magnetic material which rotates within a plane parallel and adjacent to the slide base. Magnetic sensors can discriminate coin denominations and are positioned above and below the movement path of coins conveyed by a reference guide situated at an outer circumference of the rotary path of the rotor with the rotor facing the reference guide.

In this configuration, a coin is held in a receiving portion of the rotor, and slides on the slide base made of a non-magnetic material. The rotor is also made of a non-magnetic material. Further, magnetic sensors are arranged above and below the movement path of the coin sliding on the slide base.

Detection by these magnetic sensors will not be influenced by the slide base and the rotor since they are made of non-magnetic materials. In addition, since the magnetic sensors are arranged above and below the movement path of the coin, a magnetic flux of the magnetic sensors is able to form a loop, so that metal characteristics of a coin can be efficiently obtained. Therefore, this configuration provides an advantage in that the denomination of coins can be accurately discriminated.

The magnetic sensor includes a diameter sensor, a material sensor and a thickness sensor in the coin denomination discriminating device. to detect diameter, material and thickness of the coins individually.

Therefore, real/fake determination and a denomination of a coin is discriminated based on stored discrimination data regarding diameter, material and thickness compared with the results obtained from the respective sensors, so that the accuracy of discrimination improves. Furthermore, a financial advantage is provided because these magnetic sensor may be made up of ferrite core and a coil.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In a coin denomination discriminating device which is formed of a non-magnetic material and which acquires data for discriminating coin denominations while conveying coins one by one to a predetermined position, the denomination discriminating device includes a rotor having a coin receiving portion; a magnetic sensor disposed on one side of a movement path of the coin receiving portion and on a side opposite to the one side in a facing manner; and a reference guide for guiding a coin, is disposed on an outer circumference of the movement path. The reference guide has a linear guide part and the denomination discriminating device is provided with slide base made of a non-magnetic material. A rotor made of a non-magnetic material is positioned adjacent the slide base and rotates within a plane parallel with the slide base. A magnetic sensor for discriminating coin denominations is disposed above and below the movement path of coins conveyed by the reference guide and is situated at an outer circumference of the rotary path of the rotor. The magnetic sensor includes a diameter sensor, a material sensor and a thickness sensor.

The present embodiment of the invention is used as a coin denomination discriminating device in a coin recycling apparatus that can receive eight denominations of coins, namely, 2-euro, 1-euro, 50-cent, 20-cent, 10-cent, 5-cent, 2-cent and 1 cent coins which are the current currency of the European Union (EU), hold them by coin denomination, and dispenses a specified denomination of coins based on an inputted coin dispense instruction.

However, it may also be used for a coin receiving machine that receives a plurality of denominations of coins and holds them by denomination.

Figure 1:
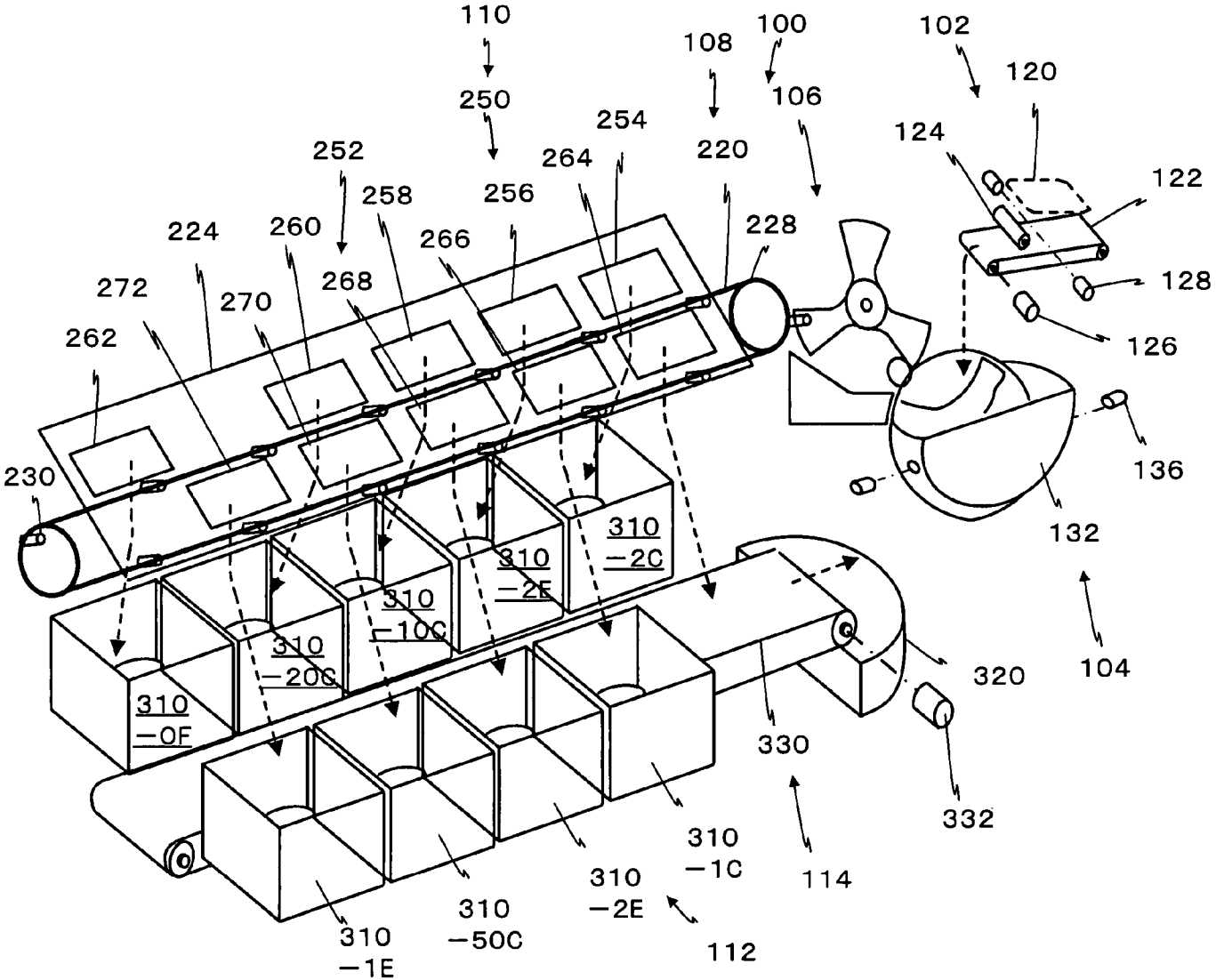
FIG. 1 is a schematic perspective view showing a coin recycling machine in which a coin denomination discriminating device embodying the present invention is used.
Figure 2:
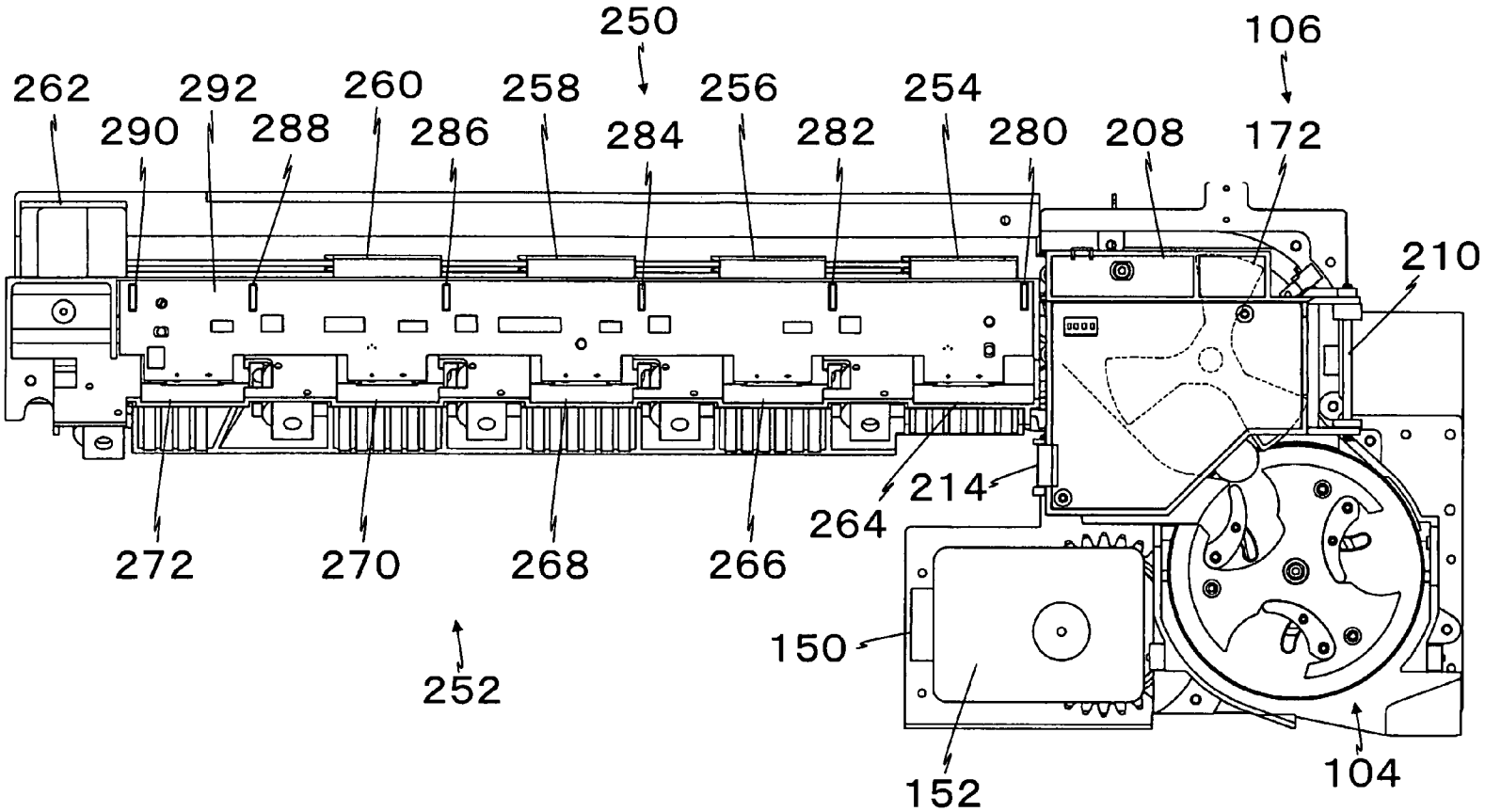
FIG. 2 is a front elevated view of a coin path in a coin receiving part of a coin recycling machine in which a coin denomination discriminating device embodying the present invention is used.
Figure 3:
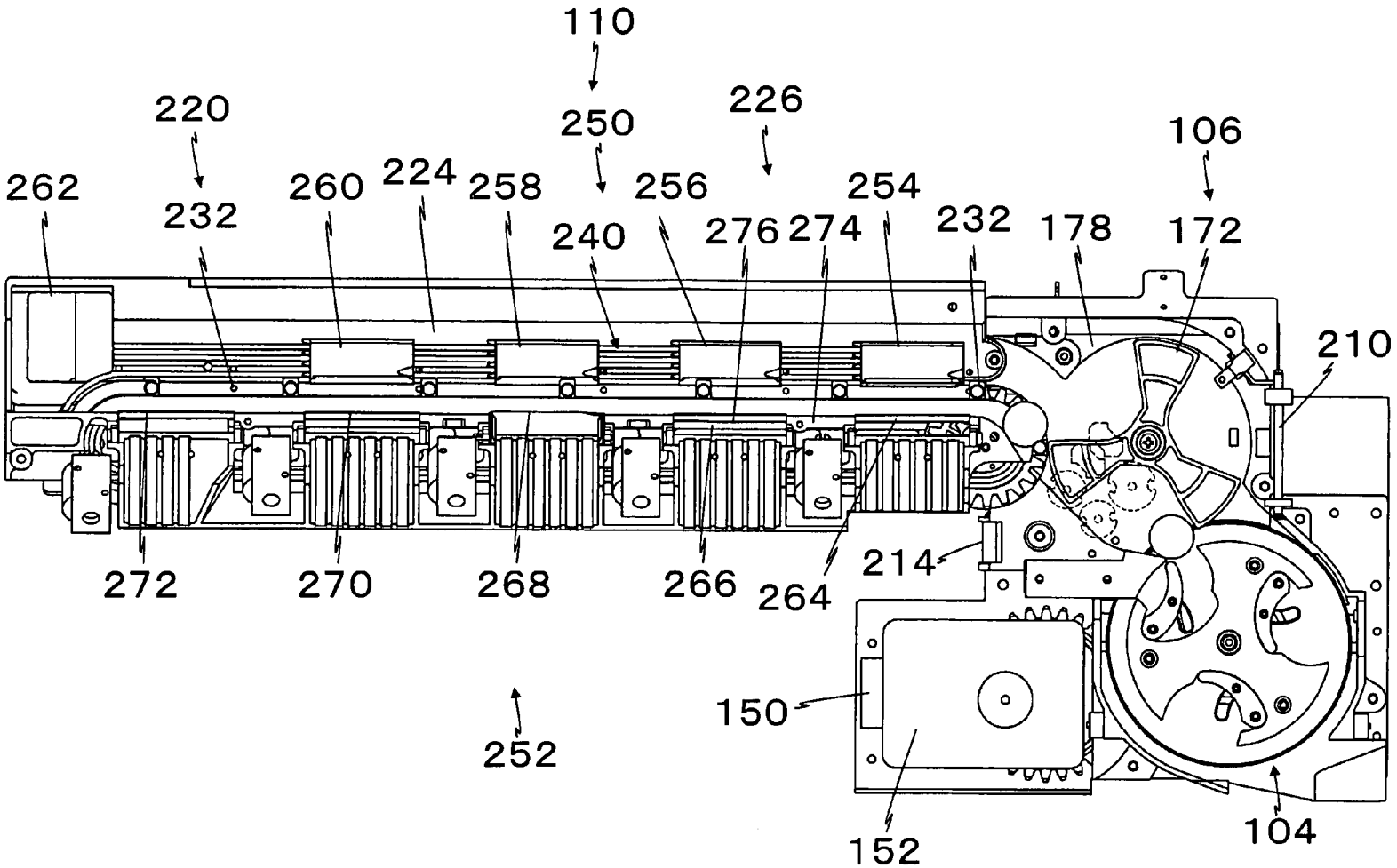
FIG. 3 is a front elevated view of a coin path without a cover, in a coin receiving part of a coin recycling machine in which a coin denomination discriminating device embodying the present invention is used.

A coin recycling apparatus 100 will be discussed with reference to FIG. 1. The coin recycling apparatus 100 includes a coin receiving amount restricting device 102, a separating and sending device 104, a coin denomination discriminating device 106, a conveying device 108, a separator 110, a holder 112 and a dispensing device 114.

First, the receiving amount restricting device 102 will be explained.

The receiving amount restricting device 102 has a function of translating a plural denominations of coins that are slotted in bulk through a slot 120, to the subsequent separating and sending device 104 in such an amount that the coins do not exceed a predetermined amount per unit of time.

Specifically, restricting device 102 includes a money reception endless flat belt 122, a coin flattening roller 124, and an electric motor 126 for driving the money reception flat belt 122. The money reception flat belt 122 has a width of about twice the diameter of the largest coin, to be processed and is stretched across a pair of rollers in a slightly upwardly inclined condition.

The money reception flat belt 122 is movable in both a forward rotary direction for conveying a coin forwardly and in a reverse rotary direction for retracting a coin by a reversible electric motor 126. The flattening roller 124 is disposed in a position above a middle part of the money reception flat belt 122 to leave a clearance space of about three times the thickness of the thinnest coin with respect to the flat belt 122.

This flattening roller 124 is so designed that when the money reception flat belt 122 moves in a conveying direction, the bottom face of the flattening roller 124 rotates in an opposite direction of the moving direction to the money reception flat belt 122, and when the money reception flat belt 122 moves in a returning direction, it stands still. However, the flattening roller 124 may be rotated in such a manner that the bottom face of the flattening roller 124 returns in the same direction when the money reception flat belt 122 moves in the returning direction.

Accordingly, when three or more thinnest coins reach the flattening roller 124 while piling up on the money reception flat belt 122, the uppermost coin is moved and dropped in the reverse direction by the flattening roller 124, whereby a large amount of coins are prevented from entering into the separating and sending device 104 at one time.

A photoelectric sensor 128 which can be a money reception detecting device is provided so that its optical axis transverses slightly above the money reception flat belt 122 while being situated below the slot 120. When an optical axis of the photoelectric sensor 128 is blocked, it is determined that a coin has entered through the slot, and the motor 126 is driven to move the money reception flat belt 122 in a money receiving direction.

When a full amount sensor of the coin separating and sending device 104 detects a full state, the motor 126 is stopped.

Therefore, the separating and sending device 104 is able to stably separate and send coins one by one without receiving coins that would exceed a full amount from the receiving money restricting device 102. The money reception detecting device may also carry out detection by a magnetic sensor placed under the money reception flat belt 122.

Figure 5:
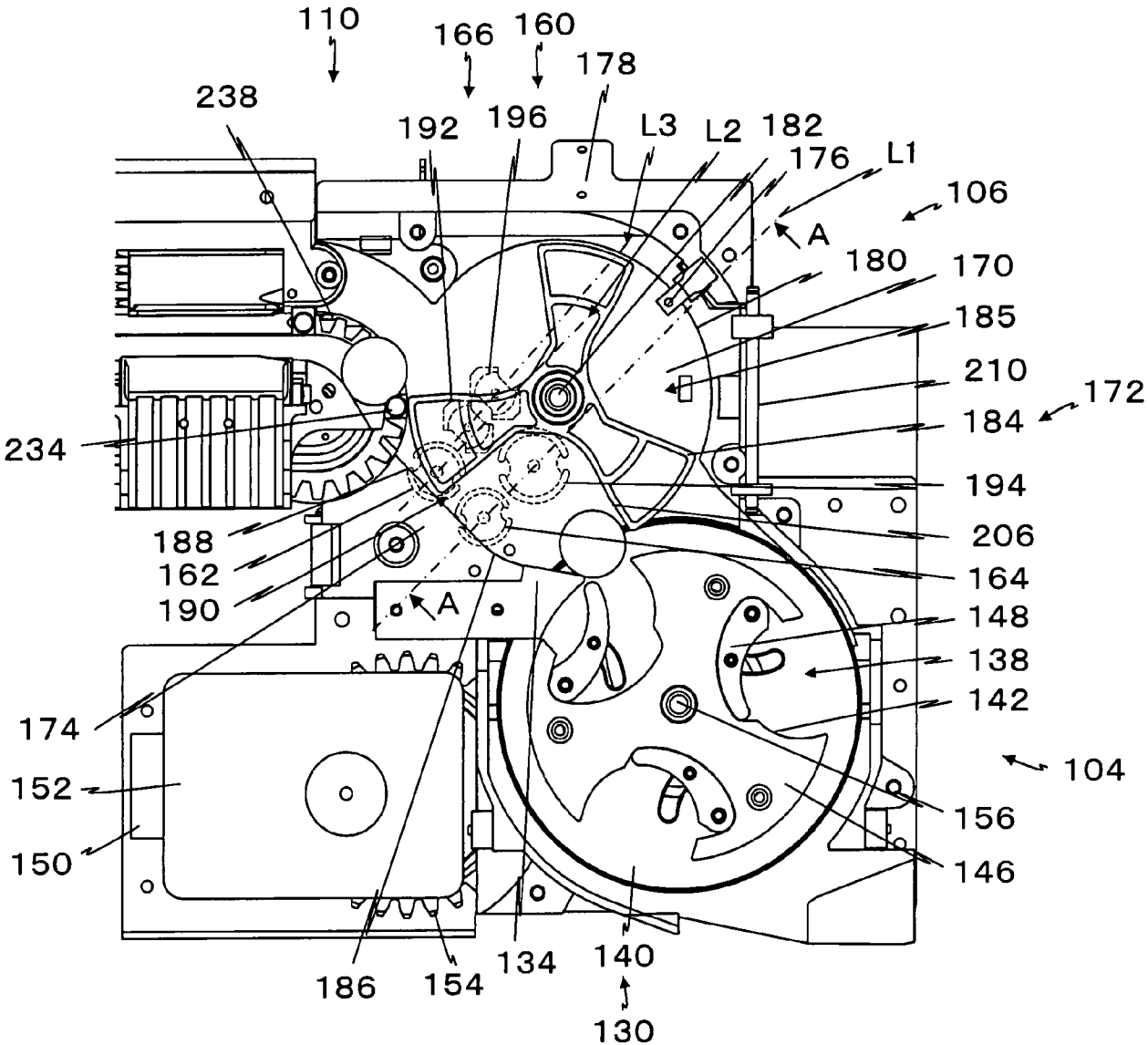
FIG. 5 is an enlarged front view of a coin denomination discriminating device embodying the present invention.

Next, the separating and sending device 104 will be explained. The separating and sending device 104 has a function of sending plural denominations of coins received in bulk from the receiving money restricting device 102 to a subsequent process while separating the coins one by one. The separating and sending device 104 is disposed under the receiving money restricting device 102 and includes a rotary plate 130, a holding bowl 132, a receiver 134 and a full sensor 136, as shown in FIGS. 1 and 5.

The rotary plate 130 has a receiving portion 138 that receives coins one by one, and is inclined at a predetermined angle and rotated at a predetermined speed. As to the receiving portion 138, a Y-shaped plate 146 formed with evenly spaced three recesses 142 is concentrically attached to a top face of a rotary disc 140. When the diameter of the disc 140 is larger, the number of receiving portions 138 may be 4 or more, and when the diameter of the disc 140 is smaller, the number of the receiving portions 138 may be 2 or less.

However, an increase in the diameter of the disc 140 is undesirable because it leads to an increase in the size of the coin recycling apparatus 100. Meanwhile, when the number of the receiving portions 138 is less than 3, the number of sending coins per unit time decreases so that a longer time period is required for the coin receiving process. Therefore, a preferred number of receiving portions 138 is 3.

On one side of the recess 142 is provided a pushing member 148 that moves pivotally. In other words, a generally semicircular receiving portion 138 is formed by the pushing member 148 and a recess 142.

The receiving portion 138, shown in FIG. 5, is sized so that it does not receive the two largest-diametric coins in a row but is able to receive a single smallest-diametric coin. The pushing member 148 is usually situated at a position nearer to one side of the recess 142 so as to form the receiving portion 138 in a stationary state, and it circumferentially sends a held coin when it pivotally moves to a predetermined position. This movement of the pushing member 148 is preferably achieved by a grooved cam using a rotary movement of the disc 140.

The receiving portion 138 of the rotary plate 130 receives coins held in bulk, one by one, in a lower part located opposite to the holding bowl 132, and the pushing member 148 pushes a coin within the receiving portion 138 in a circumferential direction at a predetermined position higher than the rotation center, and delivers it to the knife-shaped receiver 134.

Figure 4:
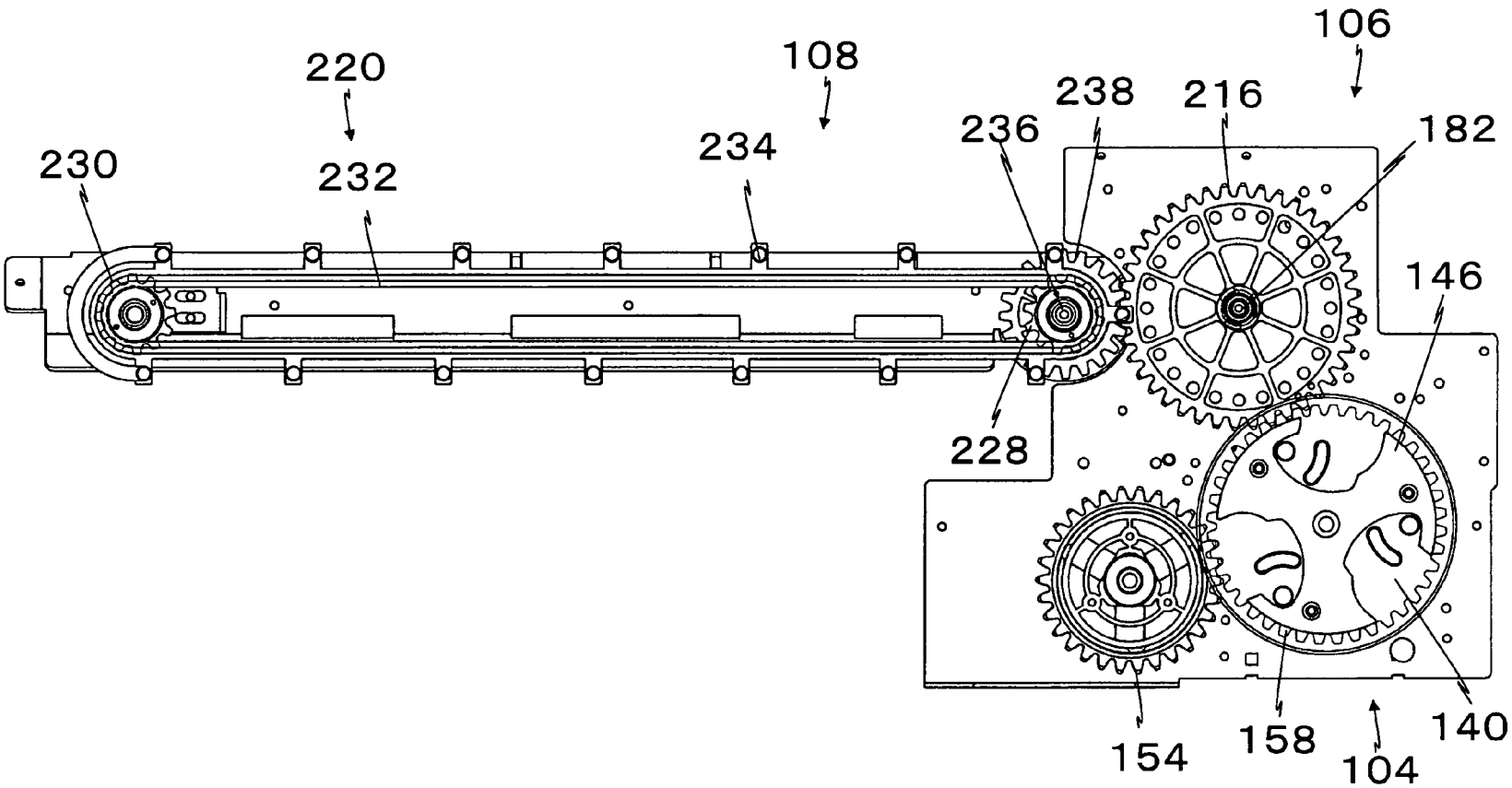
FIG. 4 is a front view of a driving mechanism of a coin receiving part of a coin recycling machine embodying the present invention.

As shown in FIG. 4, the rotary plate 130 is rotated at a predetermined speed via a driven gear 158 formed on a lower circumferential face of the disc 140 by a gear 154 that is rotated via a reducer gear unit 152 by an electric motor 150 disposed beside the disc 140.

The full amount sensor 136 has a function of outputting a full signal when the amount of coins in the holding bowl 132 exceeds a predetermined amount, and is realized by, for example, a transmissive photoelectric sensor. This is intended for eliminating the drawback that the efficiency of receiving coins into the receiving portion 138 is deteriorated due to deterioration in efficiency of stirring coins by the Y-shaped plate 146 and the pushing member 148 when the amount of coins in the holding bowl 132 exceeds a predetermined amount.

When the full sensor outputs a full signal, the electric motor 126 is stopped, and the coin supply from the receiving money restricting device 102 is stopped.

When the full amount sensor 136 no longer outputs a full signal, the electric motor 126 is restarted, and any coin on the money reception flat belt 122 is supplied to the holding bowl 132.

Next, the denomination discriminating device 106 will be explained with reference to FIGS. 5 and 6. The denomination discriminating coin device 106 has a function of discriminating between real/fake and the denomination of coins sent one by one from the separating and sending device 104 based on detection data acquired from a magnetic sensor 160 such as a coin material sensor 162, a thickness sensor 164 and a diameter sensor 166. The denomination discriminating device 106 discriminates real/fake and the denomination of coins using signals from the coin material sensor 162, the thickness sensor 164 and the diameter sensor 166 each formed of a coil and a ferrite core of a predetermined shape.

The denomination discriminating device 106 includes the magnetic sensor 160, a slide base 170 disposed in flush arrangement with the top face of the disc 140, a rotor 172 for feeding a coin, and a reference guide 174.

First, the slide base 170 will be explained. The slide base 170 is arranged aslant in a top face of a base 178, and has a function of guiding one face of a coin pushed by the rotor 172. The slide base 170 forms a bottom face of a circular hole 180 which is formed in the top face of the flat base 178 made of a non-magnetic material such as resin, and has a flat surface. The slide base 170 may be formed with a protruding strip extending in the moving direction of the coin to reduce any sliding resistance of the coin.

Next, the rotor 172 will be explained. The rotor 172 has a function of causing a coin received from the separating and sending device 104 to move and pass through the magnetic sensor 160 part one by one. Further, the rotor 172 delivers a coin having passed the magnetic sensor 160 part to the conveying device 108. The rotor 172 is formed of a non-magnetic material such as a resin, and is fixed to a rotary axis 182 protruding in a center part of the circular hole 180, and is parallel with the slide base 170, and rotatable in an adjacent plane.

The rotor 172 forms a coin receiving portion 185 with evenly-spaced three pushing levers 184 which are identical in number to the receiving portions 138, and has a somewhat Y-shape that is truncated wider as it extends radially outward from its center of rotation. Thus the coin pushing surface is inclined relative to a central radius extending outward through the middle of the lever from the center of rotation.

Next, the reference guide 174 will be explained. The reference guide 174 has a function of linearly guiding a coin passing in adjacent the magnetic sensor 160, and keeping coins at certain positions with respect to the magnetic sensor 160 according to coin denomination. The reference guide 174 has an arcuate portion 186 formed sequentially to the receiver 134 and a linear guide 188 formed in success with the arcuate portion 186, and is positioned in an outer circumference of the rotary path of the rotor 172, and guides a coin pushed by the pushing lever 184.

Preferably, the reference guide 174 is molded of polyoxymethylene which is a resin having excellent abrasion resistance for guiding a coin. The reference guide 174 may be molded integrally with the slide base 170 so as to improve the production efficiency and accuracy.

Next, the magnetic sensor 160 will be explained. The magnetic sensor 160 has a function of acquiring data for discriminating real/fake and coin denomination of coins guided by the reference guide 174. The magnetic sensors 160 are provided above and below a movement path 190 of coins which are moved by the pushing lever 184 under guidance of the reference guide 174.

The magnetic sensor 160 includes a diameter sensor 166, a thickness sensor 164 and a material sensor 162. The diameter sensor 166 has a function of acquiring data concerning the diameter of a coin moved by the rotor 172.

Euro currency coins include 8 denominations, and a 2-euro coin having the largest diameter is about twice a 1-cent coin having a smallest diameter. Therefore, it is difficult to obtain accurate data only with a single diameter sensor. In the present embodiment, a plurality of diameter sensors are provided. A first diameter sensor 192, a second diameter sensor 194 and a third diameter sensor 196 are provided.

Figure 6:
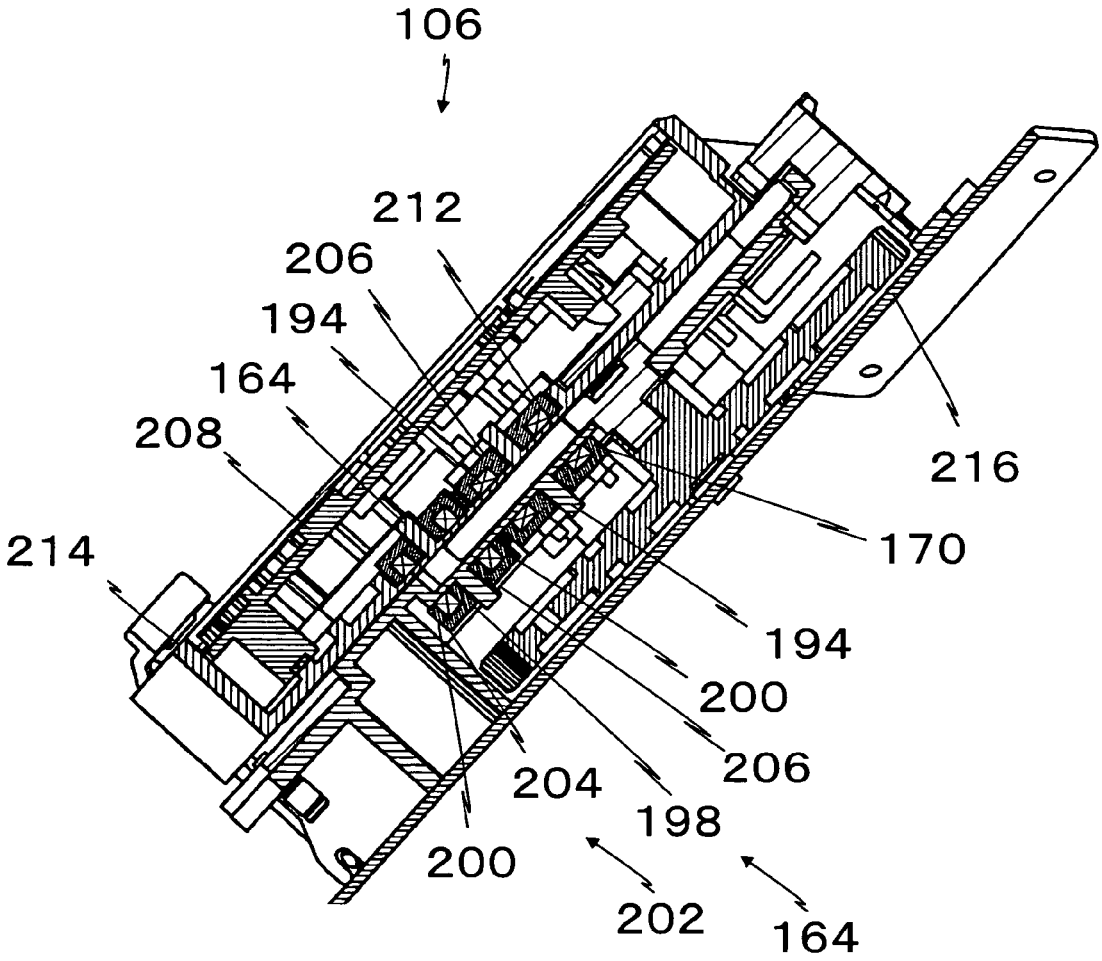
FIG. 6 is a section view along the line A-A in FIG. 5.

As shown in FIGS. 5 and 6, the material sensor 162, the thickness sensor 164 and the second diameter sensor 194 each are realized by a magnetic sensor formed by winding a coil 204 around a center cylinder 198 which comprises a core 202 of ferrite having a substantially cylindrical outer wall 200 surrounding the cylindrical center cylinder 198 and the outer circumference.

Since the magnetic sensor may be produced from a coil and a core and a high-frequency applicable circuit and the like, it is easily available and low in cost while offering accurate data. Therefore, the magnetic sensor is suited for a coin denomination discriminating device.

As shown in FIG. 5, the first diameter sensor 192 and the third diameter sensor 196 are formed into a substantially rectangular form having the cylindrical center cylinder 198 and an outer wall from which the part facing the linear guide part 188 in the outer wall 200 is removed. This rectangular design allows the first diameter sensor 192 and the third diameter sensor 196 to be adjacently positioned, so that data for achieving accurate discrimination can be obtained.

In each of the magnetic sensors 162, 164, 192, 194 and 196, a hole of the center cylinder 198 is fitted with a column positioning pin 206 protruding from the base face of the slide base 170, which are bonded by an adhesive or the like. Since the positioning pin 206 and the hole of the center cylinder 198 determine the position of the sensor, an advantage arises that the sensor is positioned readily and accurately.

The thickness sensor 164 and the second diameter sensor 194 are disposed very near the receiver 134, and arranged on a first straight line L1 which is orthogonal to the linear guide part 188. The thickness sensor 164 is disposed near the reference guide 174, and the end face of the center cylinder 198 faces a coin surface of every coin denomination.

The second diameter sensor 194 is disposed to face about one-fourth of a 2-euro coin having a largest diameter, and is disposed to face almost the entire face of a largest diametric coin that is discriminable.

The material sensor 162 is disposed in a position which is downstream from the straight line L1 and on a second straight line L2 which is substantially orthogonal to the linear guide part 188. The first diameter sensor 192 and the third diameter sensor 196 are disposed in positions which are just downstream the second straight line L2 and on a third straight line L3 which is substantially orthogonal to the linear guide part 188.

The extended line of the pushing part 206 for a coin on the pushing lever 184 of the rotor 172 is designed to intersect at an obtuse angle until the maximum diametric part of the coin comes into face contact with the material sensor 162, the first diameter sensor 192 and the third diameter sensor 196. The material sensor 162 is disposed very near the reference guide 174, and an end face of its center cylinder 198 faces the surface of every denomination of coin.

The first diameter sensor 192 is disposed in such a manner that it slightly faces an upper part of a 1-cent coin having a smallest diameter guided by the linear guide 188. The third diameter sensor 196 is disposed in such a manner that when it faces a 2-euro coin having a largest diameter, a lower half of the magnetic sensor 196 faces an upper end part of the 2-euro coin.

Each of the thickness sensor 164, the material sensor 162, the first diameter sensor 192, the second diameter sensor 194 and the third diameter sensor 196 is made up of a pair of sensors disposed above and below the movement path 190 of coin. One of the pair of sensors is fixed to a back face of the slide base 170, and the other of the sensors is fixed to an upper cover 208.

Next, the upper cover 208 shown in FIG. 5 and FIG. 6 will be explained. The upper cover 208 is pivotably attached to an axis 210 disposed above the separating and sending device 104 and arranged beside the circular hole 180. The upper cover 208 has substantially a table form when viewed planarly, and has a flat bottom face 212 which is partly in surface contact with the top face of the reference guide 174 for positioning.

In other words, the interval between the slide base 170 and the bottom face 212 is kept small and parallel by surface contact between the bottom face 212 of the upper cover 208 and the top face of the reference guide 174. The interval between the slide base 170 and the bottom face 212 is selected depending on the largest thickness of coins to be handled while taking a margin of error into account. The upper cover 208 is fixed to a hook 214 while it is in surface contact with the top face of the reference guide 174.

Therefore, in the denomination discriminating device 106, a coin is pushed by the pushing lever 184 along the thin reduced clearance movement path 190 defined by the bottom face 212 of the slide base 170 and the reference guide 174. The thickness of the pushing lever 184 is slightly smaller than the interval between the slide base 170 and the bottom face 212, and slightly thicker than the thickness of a coin having a largest thickness. This improves the abrasion resistance and facilitates production.

To a lower end of the rotary axis 182 penetrating through the slide base 170 is fixed a gear 216 which meshes with the driven gear 158. The gear ratio between the driven gear 158 and the gear 216 is 1:1, and a timing is set in such a manner that the pushing lever 184 pushes a received coin directly after the pushing member 148 pushes the coin outward of the receiving portion 138 to deliver it to the receiver 134.

Next, a timing sensor 176 in FIG. 5 will be explained. A signal is outputted from the timing sensor 176 at every passage of the pushing lever 184 and is used as a correlating signal for storing discrimination information to make a real/fake determination and coin denomination of a coin based on the data detected by the magnetic sensors 160. The timing sensor 176 is fixed to the base 178.

In the present embodiment, the timing sensor 176 can be a reflective photoelectric sensor, and outputs a pushing lever timing signal of "H" when it faces the pushing lever 184, while outputting a signal "L" when it does not face the pushing lever 184.

Next, the coin conveying device 108 will be explained. The conveying device 108 has a function of conveying a coin after being subjected to a discrimination of real/fake and its denomination to a separator 110. The conveying device 108 includes a straight guide rail 226 on which an endless conveyer 220 moves in one direction in the same plane and one face of the coin is pushed by the endless conveyer 220 to slide along the guide rail 226. The rail guide includes a coin slide plate 224 positioned in the same plane containing the slide base 170, to receive a surface of the coin.

In other words, the slide plate 224 inclines at the same angle as the slide base 170 does. This angle of inclination is preferably about 45 degrees for the sake of miniaturization of the entire coin cycling apparatus 100.

An endless conveyer 220 is implemented in this embodiment by a chain 232 stretched across a first sprocket 228 and a second sprocket 230 which are arranged at a predetermined interval. The chain 232 is arranged in a flat running track form, and the first sprocket 228 is disposed just beside the rotor 172 of the denomination discriminating device 106. The chain 232 is preferably a metal chain from the view point of durability and cost, however, it may be made of resin. On the lateral face of chain 232, pushing pins 234 are fixed at a predetermined interval.

Pushing pins 234 are attached to the chain 232 at intervals corresponding to the interval of the pushing levers 184.

At a lower part of an axis 236, to which the first sprocket 228 is fixed, a driven gear 238 is fixed which meshes with the gear 216 for driving the rotor 172. The gear ratio between the gear 238 and the gear 216 is preferably 1:3 although other gear ratios can be used. In other words, the pushing lever 184 and the pushing pin 234 cooperate in a certain predetermined relationship.

Specifically, a coin, pushed into the conveyance path 240 of the pushing pin 234 by the pushing lever 184, will be immediately pushed by the pushing pin 234.

The guide rail 226 has a function of guiding a circumferential face of a coin in such a manner that the coin pushed by the pushing pin 234 moves along the conveyance path 240. The guide rail 226 is disposed along and slightly below an upper chain of the running track form. The guide rail 226 slightly projects in the orthogonal direction beyond the largest thickness of handled coins from the slide plate 224.

Therefore, the coin pushed by the pushing pin 234 is guided at its lower face by the slide plate 224, and guided at its circumferential face, on the lower end by the guide rail 226. The guide rail 226 in this embodiment also serves as a separator.

Next, the separator 110 will be explained. The separator 110 has a function of causing coins to drop into specific separating holes for individual coin denominations. The separator 110 has an upper separator 250 disposed along and above the guide rail 226, and a lower separator 252 disposed along and below the guide rail 226.

The upper separator 250 is provided with a 2-cent separating hole 254, a 5-cent separating hole 256, a 10-cent separating hole 258, a 20-cent separating hole 260 and an overflow separating hole 262 in this order toward the moving direction of the conveying device 108. The lower separator 252 is provided with a reject separating hole 264, a 1-cent separating hole 266, a 2-euro separating hole 268, a 50-cent separating hole 270 and a 1-euro separating hole 272 in this order toward the moving direction of the conveying device 108.

In this manner, when the upper separator 250 and the lower separator 252 of the conveying device 108 are approximately arranged, it is possible to separate coins into an upper side and a lower side at the same position of the conveying device 108, so that a conveying distance for the coins is shortened and the coin recycling apparatus 100 can be miniaturized.

Each of the coin separating holes 254, 256, 258, 260, 264, 266, 268, 270 and 272 is provided with an electrically operated gate device (not shown). In the present embodiment, gate devices of the separating holes 264, 266, 268, 270 and 272 also serve as the guide rail 226. That is, the guide rail 226 consists of a stationary guide 274 fixed between the separating holes 264, 266, 268, 270 and 272, and a movable guide 276 for an electrically driven gate, and usually exhibits a linear shape.

When coins under conveyance are caused to drop into the separating holes 264, 266, 268, 270 and 272, the movable guide 276 is shifted from the usual position to prevent the conveyed coins from being guided by the movable guide 276, thereby causing coins to drop into predetermined separating holes.

Next, gate timing sensors 280, 282, 284, 286, 288 and 290 will be explained. The gate timing sensors 280, 282, 284, 286, 288 and 290 have a function of detecting a coin moved along the conveyance path 240 by the conveying device 108. A path cover 292 facing the conveyance path 240 guided by the guide rail 226 is provided with the first timing sensor 280 just before the 2-cent separating hole 254 and the reject separating hole 264. Also, just before the 5-cent separating hole 256, the second timing sensor 282 for the 5-cent separating hole 256 and the 1-cent separating hole 266 is positioned.

Just before the 10-cent separating hole 258, the third timing sensor 284 for the 10-cent separating hole 258 and the 2-euro separating hole 268 is disposed.

Just before the 20-cent separating hole 260, the fourth timing sensor 286 for the 20-cent separating hole 260 and the 50-cent separating hole 270 is disposed.

Just before the 1-euro separating hole 272, the fifth timing sensor 288 for the 1-euro separating hole 272 is disposed. Just before the overflow separating hole 262, an overflow achievement sensor 290 is positioned.

The overflow separating hole 262 is formed into a size that allows the largest coin to drop through in order that the coin holder 112 stores the overflowing predetermined denomination of coins, and is not provided with a gate.

The gate devices corresponding to the coin separating holes 254, 256, 258, 260, 264, 266, 268, 270 and 272 are selectively opened/closed based on real/fake and denomination discriminated by data detected by the first timing sensor 280, the second timing sensor 282, the third timing sensor 284, the fourth timing sensor 286, the fifth timing sensor 288, the timing sensor 176 and the magnetic sensor 160. As a result, coins conveyed by the conveying device 108 are caused to drop into a predetermined separating hole depending on their denomination.

Next, the coin holder 112 will be explained. The coin holder 112 has a function of holding coins separated by denomination in the separator 110 according to their denominations.

In the present embodiment, the coin holder 110 includes coin hoppers 310 that dispenses coins one by one by a rotary disc (not shown), provided for each denomination in two lines so as to face the upper separator 250 and the lower separator 252 below the separator 110. Each coin hopper is denoted by a reference numeral 310 added with a symbol for each denomination.

The dispensing device 114 has a function of conveying coins dispensed from a respective coin hopper for each denomination to a discharge tray 320. In the present embodiment, the dispensing device 114 is implemented by a flat belt 330 disposed between the two lines of coin hoppers. The flat belt 330 is selectively driven by an electric motor 332 so that the top face moves toward the discharge tray 320. Coins conveyed by the flat belt 330 are supplied into the discharge tray 320.

An operation of the present embodiment will now be explained. When plural denominations of coins are inserted into the slot 120, the slotted coins drop onto the money reception flat belt 122. Since the slotted coins can block the optical axis of the photoelectric sensor 128, a money reception detecting signal is outputted and the motor 126 is rotated in response to the money reception detecting signal. Accordingly, the top face of the money reception flat belt 122 moves toward the separating and sending device 104, and the coins drop from an end part of the money reception flat belt 122 and then drop into the holding bowl 132 of the separating and sending device 104.

When the coins are conveyed in piles, such piled coins are prevented from going ahead by the flattening roller 124 and caused to drop because the bottom face of the roller 124 moves oppositely to the top face of the money reception flat belt 122 due to reverse rotation of the flattening roller 124. The dropped coins are again conveyed toward the separating and sending device 104 by running of the money reception flat belt 122 in the same manner as described above. When the money reception sensor 128 no longer detects a coin, the motor 126 is stopped, and the driving of the money reception flat belt 122 is stopped.

In response to a money reception detecting signal of the photoelectric sensor 128, the motor 150 is rotated, and the gear 154 starts rotating at a predetermined speed via the reducer unit 152. Therefore, the driven gear 158 meshing with the gear 154 is rotated, and the disc 140 is rotated in a counterclockwise direction in FIG. 4. Rotation of the driven gear 154 causes the gear 216 meshing therewith to simultaneously rotate in a clockwise direction.

In other words, the rotor 172 cooperates with the disc 140 at a transmission ratio of 1:1, and rotates in a clockwise direction in FIG. 5. Further, since the driven gear 238 is driven by the gear 216, the first sprocket 228 is rotated in the counterclockwise direction in FIG. 4 via the axis 236. As a result, the chain 232 is circulated in the counterclockwise direction.

Accordingly, the coins dropped in the holding bowl 132 are stirred by the plate 146 and the pushing member 148 and coin positions thereof are changed in various ways. In the course of changing position, only one coin is received in each of the receiving portions 138. That is, a coin resides in the receiving portion 138 while one face of the coin is in surface contact with the disc 140, and the coin moves with rotation of the disc 140 while being pushed by one lateral side of the plate 146.

Immediately after the receiving portion 138 has passed an upper most position, the pushing member 148 pivots in the counterclockwise direction, and moves in the circumferential direction of the disc 140. As a result, the coin residing in the receiving portion 138 is pushed in the circumferential direction of the disc by the pushing member 148. The pushed out coin will be further pushed by the pushing lever 184 of the rotor 172 rotating in cooperation with the disc 140 immediately after it is guided by the receiver 134.

When the coins dropped into the holding bowl 132 exceed a predetermined number, a full signal is outputted from the full amount sensor 136. In response to this full signal, the motor 126 is stopped even when the photoelectric sensor 128 detects a slotted coin, and thus an excess input of coins into the separating and sending device 104 is prevented.

When the coins in the holding bowl 132 are sent out by rotation of the rotary plate 130, and a full signal is no longer outputted from the full amount sensor 136, and the photoelectric sensor 128 outputs a money reception signal, the motor 126 is actuated again, and coins on the money reception flat belt 122 are supplied to the separating and sending device 104.

Any coin pushed by the pushing lever 184 travels the movement path 190 while one face thereof is in contact with the slide base 170. At this time, the coin moves while its circumferential face is pushed against the linear guide part 188 of the reference guide 174 due to its own centrifugal force and due to a circumferentially pushing force exerted thereon because the pushing part 206 makes an obtuse angle with the reference guide 174.

In the course of this movement, the upper and lower faces of the coin face the thickness sensor 164. Although small-diametric coins such as 1-cent coin will not directly face the sensor 164, medium to large-diametric coins such as 50-cent coin and 2-euro coin face at their upper parts will interact with the upper and lower second diameter sensor 194.

The coins driven by pushing will have their upper and lower surfaces interact with the upper and lower material sensor 162, and will face the entire or one face of the upper and lower first diameter sensor 192 and the upper and lower third diameter sensor 196 after a short delay. Therefore, the output from a coil of the thickness sensor 164 varies under the influence of the thickness of the coil and outputs from the respective coils of the second diameter sensor 194, first diameter sensor 192 and third diameter sensor 196 vary under the influence of the facing area against the coin, and the output of the material sensor 162 varies under the influence of the material of the coin.

A controller can receive timing signals and output signals from the magnetic sensor unit to enable a removal of fake coins and to control its opening of gates for releasing of coins of a particular denomination to a storage hopper. Therefore, by comparing outputs from the sensors 162, 164, 192, 194 and 196 with stored predetermined reference values, it is possible to discriminate between real/fake coins and the denomination of each coin.

In particular, since coins are usually guided by the linear guide part 188 of the reference guide 174, the position where a coin faces each of the sensors is usually kept identical. In other words, since the same sampling data is obtained for the same denomination of coins, accurate discrimination is realized.

In addition, since the slide base 170, the rotor 172 and the upper cover 208 are formed of non-magnetic materials, magnetic fluxes generated by coils of the sensors will not be influenced by these components, and outputs of coils will be influenced only by any metal characteristics of the coins. This also contributes to improve the quality of the sampling data and enable coin discrimination with high accuracy.

Figure 7:
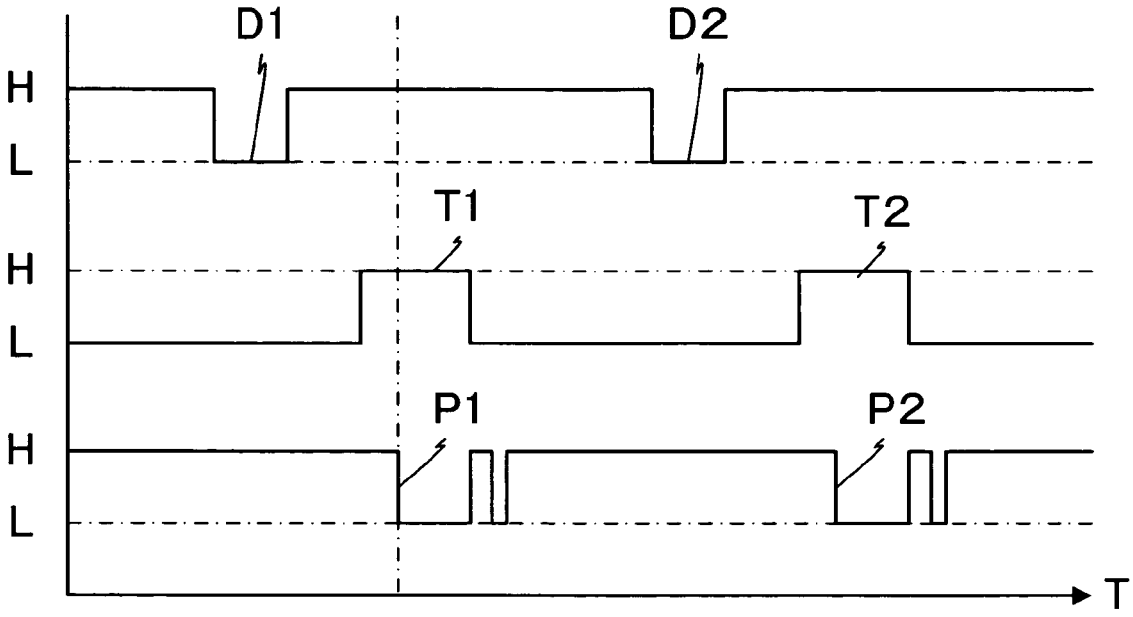
FIG. 7 is a timing chart for illustrating an operation of an embodiment of the present invention.

As shown in FIG. 7, immediately after the maximum diametric part of the coin faces with the first diameter sensor 192 and the third diameter sensor 196, a discrimination circuit (not shown) outputs a first denomination signal D1. When coins are sequentially discriminated, a second denomination signal D2 is outputted, and denomination signals will be outputted in a similar manner after that.

Immediately after the first denomination signal D1 is outputted, the timing sensor 176 detects one pushing lever 184 and outputs a timing signal T1 of "H". The first denomination signal D1 will be stored in the controller in correlation with the timing signal T1.

After facing the material sensor 162, the coin will be pushed out to the conveyance path 240 of the pushing pin 234 of the conveying device 108 by the pushing lever 184. Immediately after being pushed out to the conveyance path 240, the coin is pushed by the pushing pin 234 that is moved by the chain 232. As a result, the coin is conveyed along the conveyance path 240 while its circumferential face is guided by the guide rail 226 and its one face is in surface contact with the slide plate 224.

As the coin is conveyed along the conveyance path 240, based on coin denomination stored in correlation with the timing signals T1, T2 and of the timing sensor 176, and based on the timing signals from the first timing sensor 280, the second timing sensor 282, the third timing sensor 284, the fourth timing sensor 286 and the fifth timing sensor 288, a respective gate device corresponding to each separating hole is actuated, and a specified denomination of coin is dropped into a specific separating hole.

In the case of fake coins, the first timing sensor 280 detects a leading end of the coin and outputs a reject position signal P1 immediately after the first timing signal T1 is outputted as shown in FIG. 7. Triggered by a trailing signal of the position signal P1, the gate of the reject separating hole 264 is opened for a predetermined time period. As a result, any fake coin conveyed along the guide rail 226 that is not guided by the movable guide 276 will drop into the reject separating hole 264 to drop onto the flat belt 330 under guidance of a shoot (not shown), and will be returned to the discharge tray 320 by the flat belt 330 that is actuated by the money reception signal of the photoelectric sensor 128.

When the discriminated denomination is a 2-cent coin, the gate of the separating hole 254 is opened for a predetermined time based on the position signal outputted from the first timing sensor 280. Accordingly, the 2-cent coin conveyed under guidance of the guide rail 226 will be guided by a shoot (not shown) and stored in a 2-cent hopper 310-2C after dropping through the separating hole 254.

When the discriminated denomination is a 5-cent coin, the gate of the separating hole 256 is opened for a predetermined time based on the position signal outputted from the second timing sensor 282. Accordingly, the 5-cent coin conveyed under guidance of the guide rail 226 will be guided by a shoot (not shown) and stored in a 5-cent hopper 310-5C after dropping through the separating hole 256.

When the discriminated denomination is a 1-cent coin, the gate of the separating hole 266 is opened for a predetermined time period based on the position signal outputted from the second timing sensor 282. Accordingly, the 1-cent coin conveyed under guidance of the guide rail 226 will be guided by a shoot (not shown) and stored in a 1-cent hopper 310-1C after dropping through the separating hole 266.

When the discriminated denomination is a 10-cent coin, the gate of the separating hole 258 is opened for a predetermined time based on the position signal outputted from the third timing sensor 284. Accordingly, the 10-cent coin conveyed under guidance of the guide rail 226 will be guided by a shoot (not shown) and stored in a 10-cent hopper 310-10C after dropping through the separating hole 258.

When the discriminated denomination is a 2-euro coin, the gate of the separating hole 268 is opened for a predetermined time based on the position signal outputted from the third timing sensor 284. Accordingly, the 2-euro coin conveyed under guidance of the guide rail 226 will be guided by a shoot (not shown) and stored in a 2-euro hopper 310-2E after dropping through the separating hole 268.

When the discriminated denomination is a 20-cent coin, the gate of the separating hole 260 is opened for a predetermined time based on the position signal outputted from the fourth timing sensor 286. Accordingly, the 20-cent coin conveyed under guidance of the guide rail 226 will be guided by a shoot (not shown) and stored in a 20-cent hopper 310-20C after dropping through the separating hole 260.

When the discriminated denomination is a 50-cent coin, the gate of the separating hole 270 is opened for a predetermined time based on the position signal outputted from the fourth timing sensor 286. Accordingly, the 50-cent coin conveyed under guidance of the guide rail 226 will be guided by a shoot (not shown) and stored in a 50-cent hopper 310-50C after dropping through the separating hole 270.

When the discriminated denomination is a 1-euro coin, the gate of the separating hole 272 is opened for a predetermined time based on the position signal outputted from the fifth timing sensor 288. Accordingly, the 1-euro coin conveyed under guidance of the guide rail 226 will be guided by a shoot (not shown) and stored in a 1-euro hopper 310-1E after dropping through the separating hole 272.

When stored amounts of coins in any of the hoppers exceeds a predetermined value, namely, in the case of an overflow condition, the gate of the corresponding separating hole will not be opened. In other words, coins will drop into the overflow separating hole 262 but not in any of the separating holes, so that they are held in an overflow hopper 310-OF.

A detection signal of the overflow achievement sensor 290 is used as a signal for confirming that a coin has reached the overflow hopper 310-OF. Therefore, coins slotted through the slot 120 will be separated by a predetermined denomination separating hole based on the coin denomination discriminated by the denomination discriminating device 106.

For dispensing a specified number of coins, first, the motor 332 drives the flat belt 330 such that the top face of the belt moves toward the discharge tray 320. Then the specified number of coins are dispensed from the hopper of the specified denomination and sent out to the discharge tray 320 by the flat belt 330.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin denomination discriminating device which is formed of a non-magnetic material and which acquires acquire data for discriminating while conveying coins one by one to a predetermined position, the denomination discriminating device comprising:

a non-magnetic slide base slanting at an angle;

a coin movement path which is positioned on the non-magnetic slide base;

a non-magnetic rotor having a coin receiving portion and is located on the non-magnetic slide base;

a magnetic sensor unit including a thickness sensor, a material sensor, a first diameter sensor, a second diameter sensor and a third diameter sensor, wherein a first portion of each sensor is disposed on a first side of the coin movement path and a second portion of each sensor is disposed adjacent to the first portion of each sensor on a second side of the coin movement path to define a sensing pathway therebetween; and a non-magnetic reference guide for guiding a coin, the reference guide being disposed at an outer circumference of the coin movement path, wherein the non-magnetic reference guide has a linear guide part to engage each coin facing the magnetic sensor as the coin is guided linearly through the sensing pathway by the non-magnetic reference guide wherein the thickness sensor is disposed on a first straight reference line which is defined orthogonal to the non-magnetic reference guide, wherein the second diameter sensor is disposed on the first straight reference line in a position outboard of the thickness sensor in relation to the linear guide part, and wherein the material sensor is disposed on a second straight reference line, in a position which is downstream from the first straight reference line, which is substantially orthogonal to the non-magnetic reference guide, the first diameter sensor and the third diameter sensor are disposed on a third straight reference line in positions downstream from the second straight reference line, the third straight reference line is substantially orthogonal to the non-magnetic reference guide.

2. The coin denomination discriminating device according to claim 1, wherein the denomination discriminating device is provided with a slide base made of a non-magnetic material, the non-magnetic rotor is positioned adjacent the slide base and rotates within a plane parallel to a surface of the slide base, and the magnetic sensor unit is disposed above and below the coin movement path of the coins defined by the linear guide part and the non-magnetic rotor passes between the magnetic sensor unit in the coin movement path.

3. The coin denomination discriminating device according to claim 2, wherein the magnetic sensor includes a diameter sensor, a material sensor and a thickness sensor.

4. The coin discriminating device of claim 3 wherein the non-magnetic slide base and the non-magnetic reference guide are formed integrally of a plastic resin.

5. The coin discriminating device of claim 4 wherein the non-magnetic rotor has three evenly spaced pushing levers and each lever is truncated wider as the lever extends radially outward from a center of rotation, the non-magnetic rotor is formed of a plastic resin.

6. A compact coin discriminating device for receiving coins from a coin sending device operatively connected to a coin holding bowl and delivering the coins to storage hoppers, comprising:

a plastic resin rotor with a plurality of coin pushing levers;

a plastic resin guide member;

a plastic slide base member; and a magnetic sensor unit, including a thickness sensor, a material sensor, a first diameter sensor, a second diameter sensor and a third diameter sensor, wherein a first portion of each sensor is disposed on a first side of the plastic slide base member and a second portion of each sensor is disposed adjacent to the first portion of each sensor on a second side of the plastic slide base member to define a sensing pathway therebetween, wherein the rotor is mounted to rotate across a surface of the slide base member with the plurality of coin pushing levers moving adjacent the plastic resin guide member and through the sensing pathway, the magnetic sensor unit is positioned to monitor a coin moving adjacent the plastic resin guide member to provide characteristic signals of the coin as one of the coin pushing levers moves the coin to slide across the base member in a coin path through the sensing pathway, wherein the thickness sensor is disposed on a first straight reference line which is defined orthogonal to the plastic resin guide member, wherein the second diameter sensor is disposed on the first straight reference line in a position outboard of the thickness sensor in relation to the guide member, and wherein the material sensor is disposed on a second straight reference line, in a position which is downstream from the first straight reference line, which is substantially orthogonal to the plastic resin guide member, the first diameter sensor and the third diameter sensor are disposed on a third straight reference line in positions downstream from the second straight reference line, the third straight reference line is substantially orthogonal to the plastic resin guide member.

7. The compact coin discriminating device of claim 6 wherein the rotor has three coin pushing levers.

8. The compact coin discriminating device of claim 7 wherein each coin pushing lever has a coin pushing surface that is inclined relative to a central radius of the pushing lever.

9. The compact coin discriminating device of claim 6 wherein the plastic slide base member and the plastic resin guide member are integrally molded of a polyoxylmethylene material.

10. The compact discriminating device of claim 6 wherein each sensor includes a coil and a ferrite core.

11. A coin dispensing device comprising, a coin restricting device including an endless belt for translating inserted coins beneath a roller to control the entrance of coins;

a coin holding bowl for receiving coins from the coin restricting device;

a coin separating device for removing individual coins from the coin holding bowl;

a non-magnetic rotor having a coin receiving portion;

a magnetic sensor unit disposed on opposite sides of a coin movement path of the coin receiving portion to define a sensing pathway therebetween for providing signals characteristic of the coins, the magnetic sensor unit including a thickness sensor, a material sensor, a first diameter sensor, a second diameter sensor and a third diameter sensor;

a non-magnetic reference guide for guiding a coin, positioned on an outer circumference of the coin movement path to guide the coin as it is being moved by the rotor, wherein the thickness sensor is disposed on a first straight reference line which is defined orthogonal to the non-magnetic reference guide, wherein the second diameter sensor is disposed on the first straight reference line in a position outboard of the thickness sensor in relation to the reference guide, and wherein the material sensor is disposed on a second straight reference line, in a position which is downstream from the first straight reference line, which is substantially orthogonal to the non-magnetic reference guide, the first diameter sensor and the third diameter sensor are disposed on a third straight reference line in positions downstream from the second straight reference line, the third straight reference line is substantially orthogonal to the non-magnetic reference guide;

a timing sensor provides timing signals representative of each coin moved along the coin movement path;

a coin conveying device includes an inclined slide plate and an endless conveyer to receive a coin from the non-magnetic rotor and slides the coin along the inclined slide plate, and a controller for timing the release of coins from the coin conveying device based on the timing signals and the signals characteristic of the coins.

12. The coin dispensing device according to claim 11 wherein the non-magnetic reference guide has a linear guide part.

13. The coin dispensing device according to claim 12 wherein the magnetic sensor unit includes a diameter sensor, a material sensor and a thickness sensor.

14. The coin dispensing device according to claim 13 wherein the rotor and reference guide are formed of a plastic resin.

15. The coin dispensing device according to claim 14 wherein the rotor has three coin pushing levers.

16. The coin dispensing device according to claim 15 wherein each coin pushing lever has a coin pushing surface that is inclined relative to a central radius of the pushing lever.

17. The coin dispensing device according to claim 14 wherein the plastic slide base member and reference glide member are integrally molded of a polyoxylmethylene material.

18. The coin dispensing device according to claim 15 wherein the magnetic sensor unit includes a diameter sensor, a material sensor and a thickness sensor positioned on either side of the rotor along the coin path and the three coin pushing levers position a coin on the linear guide part and each of the three coin pushing levers pass through the magnetic sensor unit.

19. The coin dispensing device according to claim 18 wherein each sensor includes a coil and a ferrite core.

20. A coin denomination discriminating device which is formed of a non-magnetic material and which acquires acquire data for discriminating while conveying coins one by one to a predetermined position, the denomination discriminating device comprising:

a non-magnetic slide base slanting at an angle;

a coin movement path which is positioned on the non-magnetic slide base;

a non-magnetic rotor having a coin receiving portion and is located on the non-magnetic slide base; and a sensing means for acquiring data for discriminating between authenticity and denomination of coins guided by a guiding means for guiding the coin through a sensing pathway defined by the sensing means.

* * * * *